US007060004B2

(12) United States Patent
Kuo

(10) Patent No.: US 7,060,004 B2
(45) Date of Patent: Jun. 13, 2006

(54) EXERCISER HAVING EASILY ADJUSTABLE MECHANISM

(76) Inventor: Hai Pin Kuo, No. 15, Lane 833, Wen Hsien Road, Tainan City (TW) 704

( * ) Notice: Subject to any disclaimer, the term of this patent is extended or adjusted under 35 U.S.C. 154(b) by 51 days.

(21) Appl. No.: 10/626,035

(22) Filed: Jul. 23, 2003

(65) Prior Publication Data

US 2004/0209741 A1 Oct. 21, 2004

Related U.S. Application Data

(63) Continuation-in-part of application No. 09/739,312, filed on Dec. 19, 2000, now Pat. No. 6,620,079.

(51) Int. Cl.
*A63B 22/00* (2006.01)

(52) U.S. Cl. ..... 482/52; 482/51

(58) Field of Classification Search ..... 482/51, 482/54, 52–53, 70, 1–8, 57
See application file for complete search history.

(56) References Cited

U.S. PATENT DOCUMENTS 4,771,148 A * 9/1988 Bersonnet ..... 200/61.58 R
5,031,901 A * 7/1991 Saarinen ..... 482/63
5,743,834 A * 4/1998 Rodgers, Jr. ..... 482/57
6,027,430 A * 2/2000 Stearns et al. ..... 482/51
6,146,313 A * 11/2000 Whan-Tong et al. ..... 482/51
6,277,054 B1 * 8/2001 Kuo ..... 482/51
6,409,636 B1 * 6/2002 Risso et al. ..... 482/82
6,450,925 B1 * 9/2002 Kuo ..... 482/52
6,454,682 B1 * 9/2002 Kuo ..... 482/52
6,620,079 B1 * 9/2003 Kuo ..... 482/51

* cited by examiner

*Primary Examiner*—Stephen R. Crow
(74) *Attorney, Agent, or Firm*—Charles E. Baxley

(57) ABSTRACT

A stepping exerciser includes a pair of bars pivotally secured to a front portion of a base and each having an upper portion for being grasped by hands of users, and each having a lower portion coupled to a wheel to rotate and drive the wheel when the bars swing relative to the base. Two-foot supports may be used for supporting the users. A brake device is disposed close to the wheel for braking the wheel, and a switch is disposed on the upper portion of one of the bars, to actuate the brake device to brake the wheel with the hand of the user that holds the upper portion of the bar, without stopping the exerciser.

1 Claim, 4 Drawing Sheets

EXERCISER HAVING EASILY ADJUSTABLE MECHANISM

The present invention is a continuation-in-part of U.S. patent application Ser. No. 09/739,312, filed 19 Dec. 2000 now U.S. Pat. No. 6,620,079.

BACKGROUND OF THE INVENTION

1. Field of the Invention

The present invention relates to a stepping exerciser, and more particularly to a stepping exerciser having an adjustable mechanism for easily adjusting the resistive force against the movement or operation of the stepping exercisers while operating or actuating the stepping exercisers, without stopping the stepping exercisers.

2. Description of the Prior Art

Various kinds of typical stepping exercisers have been developed for conducting stepping or walking exercises or the like, and comprise a pair of foot supports movable along elliptical moving paths or elliptical strides, and may further comprise a brake device or the like for applying a resistive force or a braking force against the movement or operation or actuation of the stepping exercisers.

However, normally, the users should stop operating the stepping exercisers, before they may adjust the resistive forces against the movement or operation of the stepping exercisers; i.e., the resistive forces may not be adjusted while the exercisers are working or operating by the users. In addition, it will be difficult to adjust the resistive forces against the movement or operation of the stepping exercisers.

The present invention has arisen to mitigate and/or obviate the afore-described disadvantages of the conventional stepping exercisers.

SUMMARY OF THE INVENTION

The primary objective of the present invention is to provide a stepping exerciser including an adjustable mechanism for easily adjusting the resistive force against the movement or operation of the stepping exercisers while operating or actuating the stepping exercisers, without stopping the stepping exercisers.

In accordance with one aspect of the invention, there is provided a stepping exerciser comprising a base including a front portion, a pair of bars pivotally secured to the front portion of the base, and each including an upper portion for being grasped by hands of users, and each including a lower portion, a wheel rotatably supported on the base, means for coupling the lower portions of the bars to the wheel, to rotate and drive the wheel when the bars swing relative to the front portion of the base, the coupling means including a pair of foot supports for supporting the users, a brake device disposed close to the wheel for braking the wheel, and a switch provided on the upper portion of a first bar of the pair of bars, to actuate the brake device to brake the wheel with the hand of the user that holds the upper portion of the first bar. The brake device may be directly actuated by the switch, with the hand of the user that holds the upper portion of the handle of the bar, in order to be actuated to brake the wheel, while the user is actuating or operating the stepping exerciser, without stopping the exerciser.

A driving device is further provided and coupled between the switch and the brake device, for being actuated by the switch to operate the brake device. The driving device includes a driver circuit coupled to the brake device, to actuate the brake device. The driving device includes a CPU coupled to the driver circuit. The driving device includes a control board having a CPU coupled to the switch for being actuated by the switch.

Further objectives and advantages of the present invention will become apparent from a careful reading of the detailed description provided herein below, with appropriate reference to the accompanying drawings.

DETAILED DESCRIPTION OF THE PREFERRED EMBODIMENT

Figure 1:
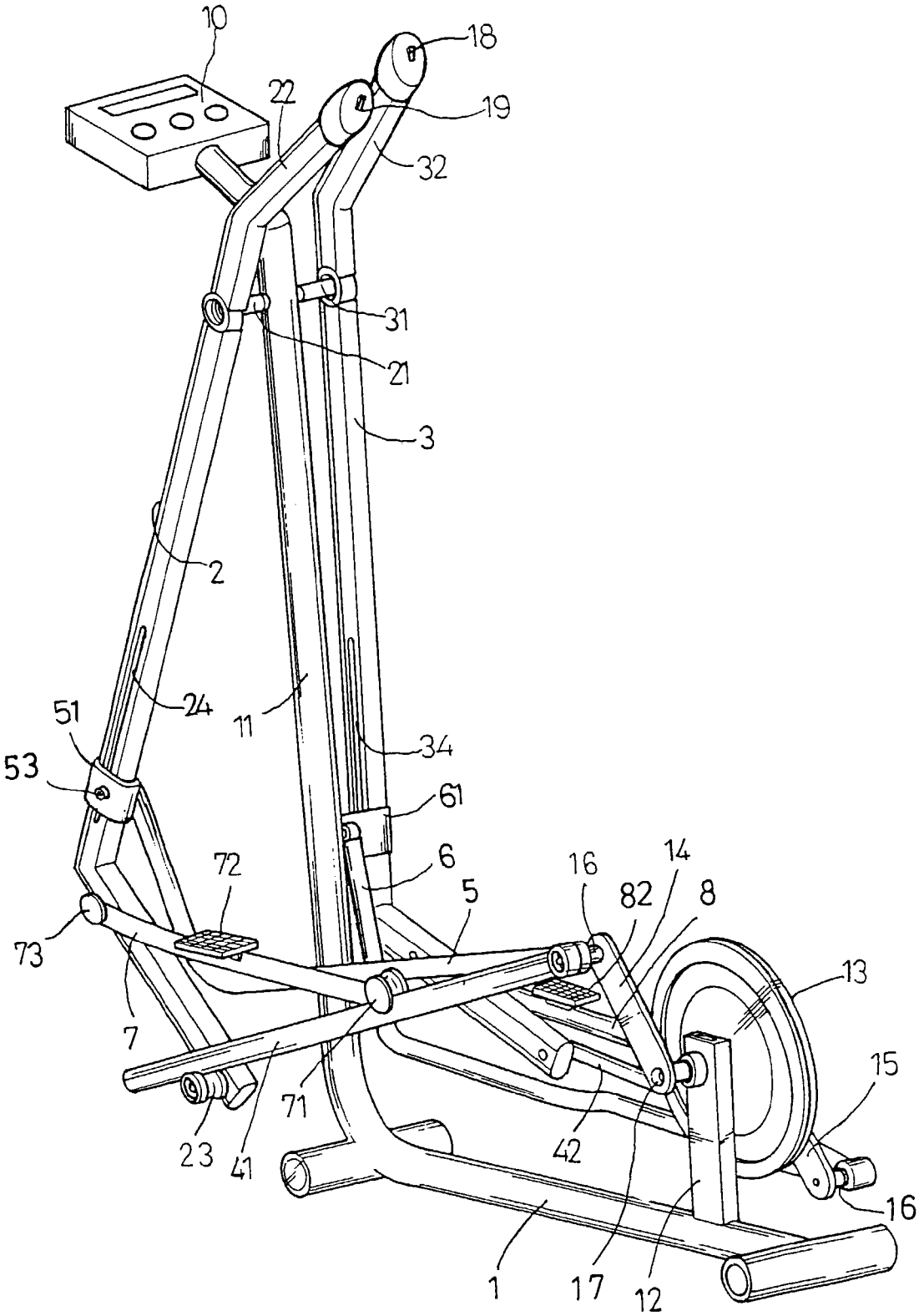
FIG. 1 is a perspective view of a stepping exerciser in accordance with the present invention.
Figure 2:
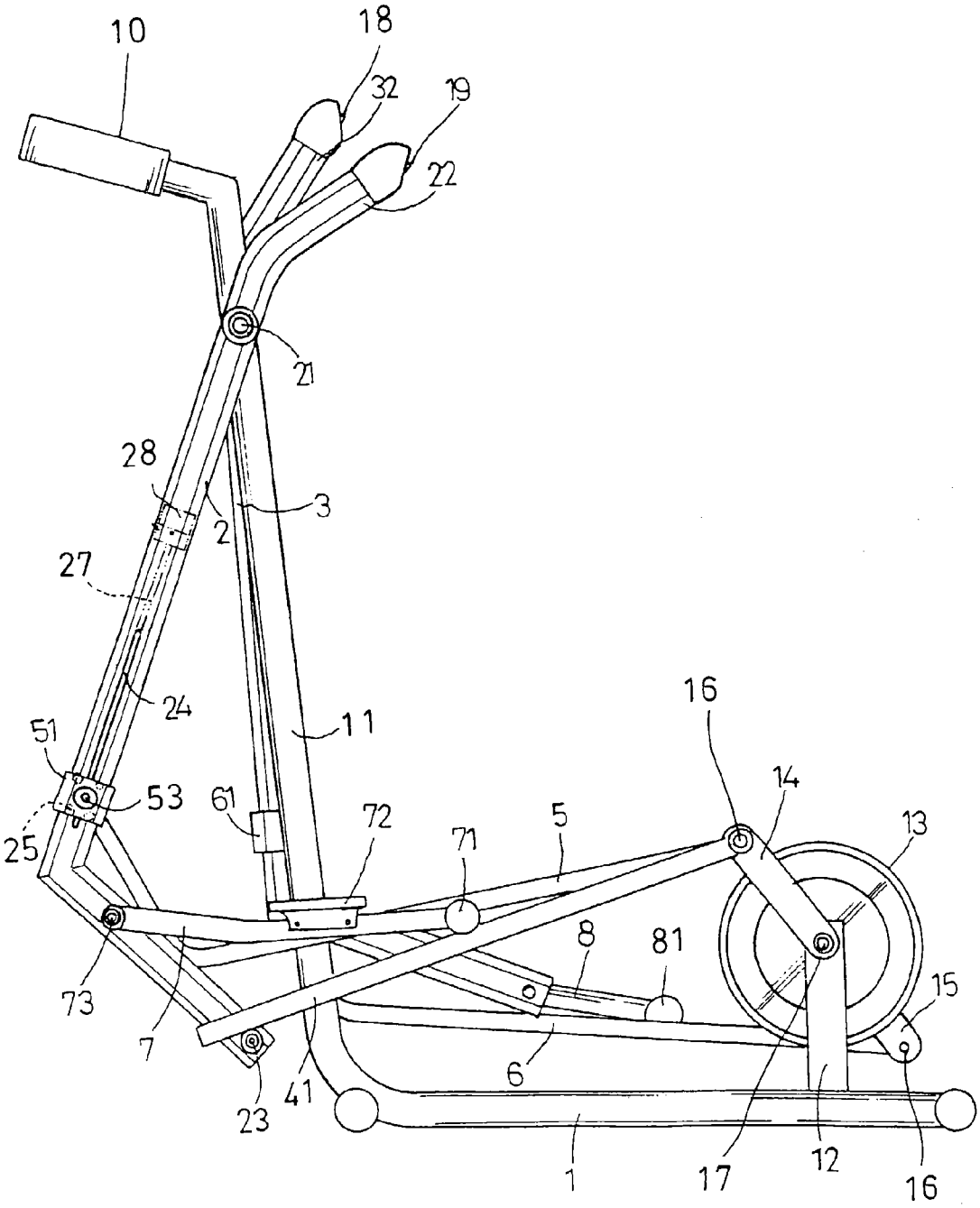
FIG. 2 is a side plan view of the stepping exerciser.

Referring to the drawings, and initially to FIGS. 1 and 2, a stepping exerciser in accordance with the present invention comprises a base 1 including a post 11 extended upwardly from or provided on the front portion thereof, and including a stay 12 extended upwardly from or provided on the rear portion thereof. A control box 10 or the like is disposed on top of the post 11 for controlling the operation of the exerciser.

A wheel 13 and a pair of cranks 14, 15 are rotatably secured or supported on the stay 12 with a pivot shaft 17, and rotatable about the pivot shaft 17. The cranks 14, 15 are extended away from each other as that for the typical cycling devices, and each includes a free end having an axle 16 attached thereto. The wheel 13 may be used as a resistive device to provide a resistive force against the operation of the exerciser.

A pair of bars 2, 3 have a middle or upper portion rotatably or pivotally secured to the upper portion of the post 11 with one or more rods 21, 31, and each includes a handle 22, 32 formed or provided on top thereof, and each includes a hollow chamber (not shown) formed in the inner portion thereof, and each includes one or more slots 24, 34 formed in the middle or lower portion thereof, and located or provided below the rods 21, 31.

Each of the bars 2, 3 further includes a bottom end having a roller or pulley 23 attached thereto or provided thereon. A pair of tracks 41, 42 have a middle portion slidably or movably supported on the respective pulleys 23, and each includes one end rotatably or pivotally secured to the free ends of the cranks 14, 15 with the axles 16 respectively.

A pair of levers 7, 8 each includes a front end rotatably or pivotally secured to the lower portions of the bars 2, 3 with a pivot pin 73, and each includes a pulley 71, 81 attached to or provided on the rear portion thereof, and rotatably or slidably or movably engaged on the respective tracks 41, 42, and each has a foot support 72, 82 provided on the middle portion thereof, for supporting users thereon.

A pair of sleeves 51, 61 are slidably engaged on the respective bars 2, 3, and secured to a respective slide 25 (as shown in dotted lines in FIG. 2) with a pole 53. The slides 25 are slidably received in the bars 2, 3 respectively, and the poles 53 are slidably engaged in the slots 24, 34 of the bars 2, 3 respectively, for guiding the sleeves 51, 61 to move up and down along the bars 2, 3 respectively. A bolt 27 is threaded or engaged with each of the slides 25, and, driven by a motor 28, which may thus be used to move the sleeves 51, 61 up and down along the bars 2, 3 respectively.

A pair of links 5, 6 each includes one end rotatably or pivotally secured to the free ends of the cranks 14, 15 with the axles 16 respectively, and each includes the other end rotatably or pivotally secured to the respective sleeves 51, 61 with the pivot poles 53, such that the other ends of the links 5, 6 may also be moved or adjusted up and down along the bars 2, 3 respectively by the motor 28.

The foot supports 72, 82 may thus also be adjusted relative to the bars 2, 3 respectively by the motor 28, in order to adjust the moving strides or moving strokes of the foot supports 72, 82, when the sleeves 51, 61 are adjusted or moved up and down along the bars 2, 3 respectively.

A switch 18 is disposed on top of one of the bars 2, 3, such as disposed on top of the handle 32 of the bar 3, and is coupled to the motor 28 and/or the control box 10, for operating or actuating the motor 28 to adjust the sleeves 51, 61 of the links 5, 6, and thus the foot supports 72, 82 relative to the bars 2, 3 respectively, and thus to adjust the moving strides or moving strokes of the foot supports 72, 82.

The above-described configuration has been disclosed in the co-pending U.S. patent application No. 09/739,312, filed 19 Dec. 2000, which is taken as a reference for the present invention.

Figure 3:
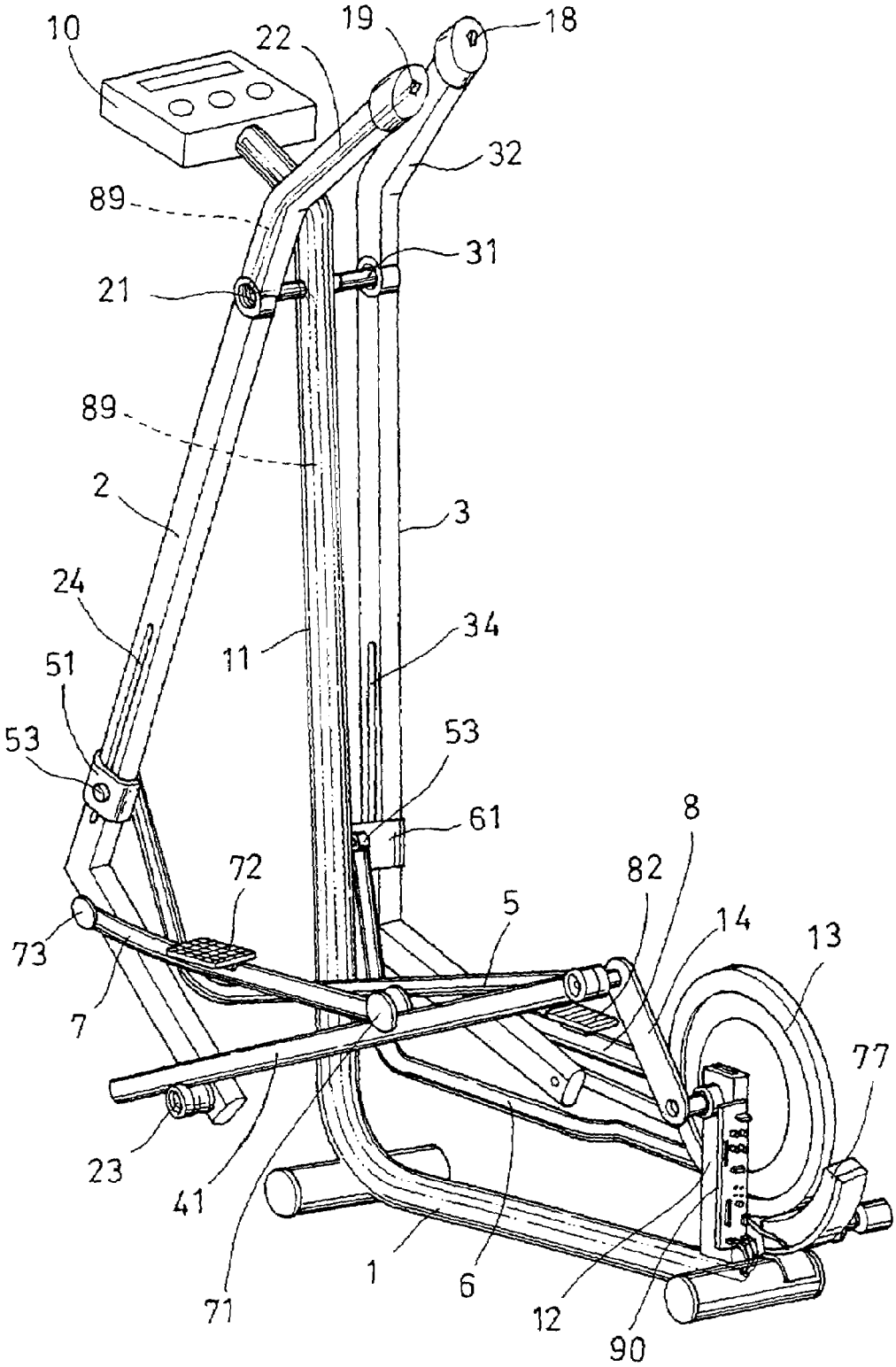
FIG. 3 is a perspective view similar to FIG. 1, illustrating the connection or the coupling of the electric facilities of the stepping exerciser.
Figure 4:
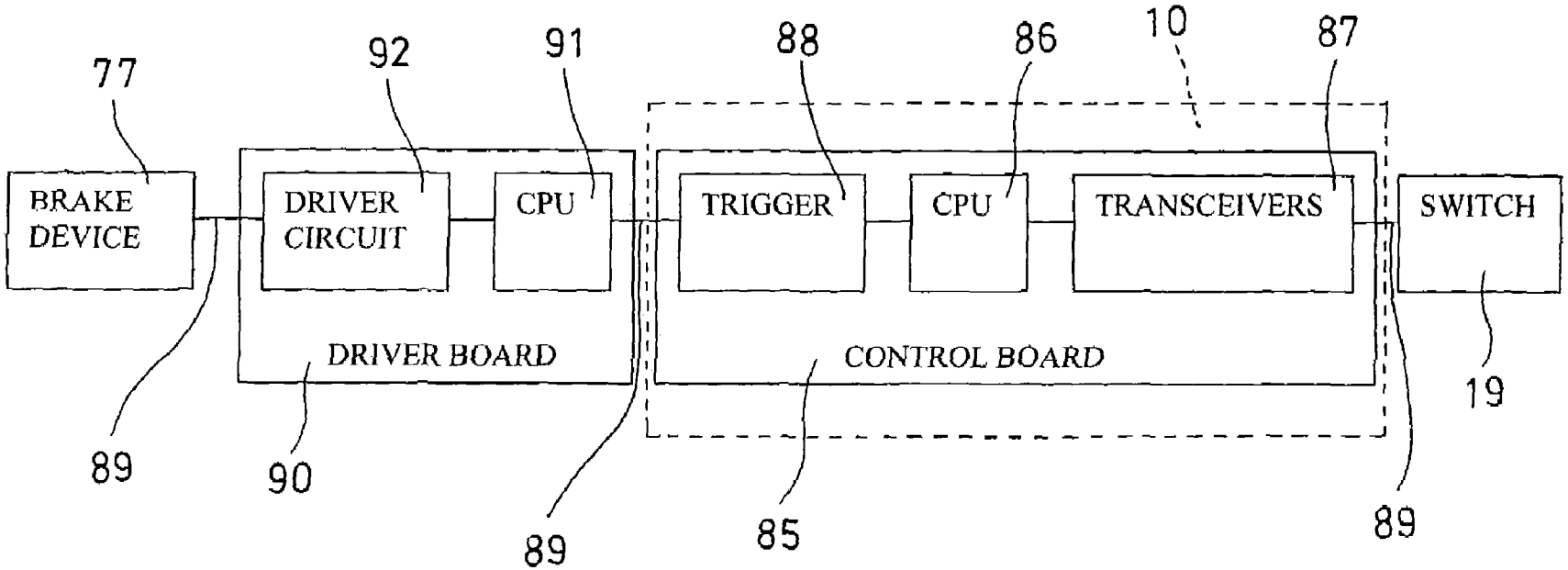
FIG. 4 is a block diagram illustrating the operating or controlling circuit for the brake device of the stepping exerciser.

Referring next to FIGS. 3 and 4, the stepping exerciser in accordance with the present invention further comprises a brake device 77 provided close to or beside the wheel 13 for braking the wheel 13, or for applying a brake force, such as a magnetic braking force against the wheel 13, in order to provide a resistive force or a braking force against the movement or operation or actuation of the stepping exercisers.

Another switch 19 is disposed on top of the other bar 2, such as disposed on top of the handle 22 of the bar 2, and is provided for operating or actuating the brake device 77 to brake the wheel 13, and thus to provide a resistive force or a braking force against the movement or operation or actuation of the stepping exercisers.

For example, as shown in FIG. 4, a control board 85 is disposed in the control box 10, and includes a central processing unit (CPU) 86 for computerized programming purposes, and/or for controlling purposes, one or more transceivers 87 coupled to the CPU 86, for coupling to the switch 19 with electric wires or cables 89, and a trigger 88 coupled to the CPU 86.

A driver board 90 is further provided and attached to such as the stay 12 of the base 1, and includes a central processing unit (CPU) 91 for computerized programming purposes, and/or for controlling purposes, and for coupling to the trigger 88 of the control board 85 with electric wires or cables 89, and a driver circuit 92 coupled to the CPU 91, and coupled the brake device 77 with electric wires or cables 89, in order to operate or actuate the brake device 77 to brake the wheel 13.

In operation, the hand of the user that holds the upper portion of the handle 22 of the bar 2 may directly depress or actuate the switch 19, in order to actuate the brake device 77 to brake the wheel 13, while the user is actuating or operating the stepping exerciser, without stopping the exerciser.

The driver circuit 92 of the driver board 90 may be actuated by the switch 19 and/or the control board 85, in order to change the electromagnetic force of the brake device 77, or in order to change the electromagnetic force applied to the brake device 77, so as to adjust the brake force of the brake device 77 against the wheel 13.

Accordingly, the stepping exerciser in accordance with the present invention includes an adjustable mechanism for easily adjusting the resistive force against the movement or operation of the stepping exercisers while operating or actuating the stepping exercisers, without stopping the stepping exercisers.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stepping exerciser comprising:

a base including a front portion, a pair of bars pivotally secured to said front portion of said base, and each including an upper portion for being grasped by the hands of a user, and each including a lower portion, a wheel rotatably supported on said base, a pair of cranks attached to said wheel and rotated in concert with said wheel, and each including a free end, means for coupling said lower portions of said bars to said free ends of said cranks, to rotate and drive said wheel when said bars swing relative to said front portion of said base, said coupling means including a pair of foot supports for supporting the users, a brake device disposed close to said wheel for braking said wheel, a switch provided on said upper portion of a first bar of said pair of bars, to actuate said brake device to brake said wheel with the hand of the user that holds said upper portion of said first bar, and a driving means coupled between said switch and said brake device to operate said brake device by said switch, said driving means including a driver circuit coupled to said brake device, to actuate said brake device, a CPU coupled to said driver circuit, and a control board having a CPU coupled to said switch for being actuated by said switch.

* * * * *